US009915481B2

(12) United States Patent
Nakamura et al.

(10) Patent No.: US 9,915,481 B2
(45) Date of Patent: Mar. 13, 2018

(54) FIN FOR HEAT EXCHANGER

(71) Applicant: DENSO CORPORATION, Kariya, Aichi-pref. (JP)

(72) Inventors: Mitsugu Nakamura, Kariya (JP); Masahiro Shimoya, Kariya (JP); Tadashi Nakabou, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 244 days.

(21) Appl. No.: 14/903,392

(22) PCT Filed: Jul. 7, 2014

(86) PCT No.: PCT/JP2014/003598
§ 371 (c)(1),
(2) Date: Jan. 7, 2016

(87) PCT Pub. No.: WO2015/004899
PCT Pub. Date: Jan. 15, 2015

(65) Prior Publication Data

US 2016/0153727 A1 Jun. 2, 2016

(30) Foreign Application Priority Data

Jul. 12, 2013 (JP) ..... 2013-146325

(51) Int. Cl.
*F28D 1/04* (2006.01)
*F28F 3/02* (2006.01)
(Continued)

(52) U.S. Cl.
CPC ..... *F28F 3/027* (2013.01); *F28D 1/05383* (2013.01); *F28F 1/128* (2013.01)

(58) Field of Classification Search
CPC .... F28F 3/027; F28F 1/128; F28F 1/10; F28F 1/12; F28F 1/24; F28F 1/32; F28D 1/05383; F28D 1/04
(Continued)

(56) References Cited

U.S. PATENT DOCUMENTS 1,416,570 A * 5/1922 Modine ..... F28F 1/325 165/151
3,724,538 A * 4/1973 Yamaguchi ..... B21D 13/04 165/152
(Continued)

FOREIGN PATENT DOCUMENTS

JP S61046756 B2 10/1986
JP H05196383 A 8/1993
(Continued)

OTHER PUBLICATIONS

International Search Report and Written Opinion (in Japanese with English Translation) for PCT/JP2014/003598, dated Sep. 22, 2014; ISA/JP.

*Primary Examiner* — Justin Jonaitis
(74) *Attorney, Agent, or Firm* — Harness, Dickey & Pierce, P.L.C.

(57) ABSTRACT

A fin for a heat exchanger is joined to an outer surface of a tube, and facilitates a heat exchange between the tube and an air flowing around the tube. A sectional surface of the fin perpendicular to a flowing direction of an air has a corrugated shape that includes multiple flat portions substantially parallel to a flowing direction of the air, and a ridge portion connecting the adjacent flat portions. Multiple louvers cut in and raised from each of the flat portions at a predetermined cut-and-raised angle are disposed on the flat portion along a flowing direction of the air. A thickness of each flat portion is defined as t, a louver pitch of the louvers is defined as PL,
(Continued)

and the thickness of each flat portion and the louver pitch satisfy a relationship of 0.035≤t/PL≤0.29.

5 Claims, 14 Drawing Sheets

(51) Int. Cl.
*F28D 1/053* (2006.01)
*F28F 1/12* (2006.01)

(58) Field of Classification Search
USPC ..... 165/151, 148
See application file for complete search history.

(56) References Cited

U.S. PATENT DOCUMENTS 4,332,293 A * 6/1982 Hiramatsu ..... F28F 1/128 165/153
4,365,667 A * 12/1982 Hatada ..... F28F 1/325 165/151
4,469,167 A * 9/1984 Itoh ..... F24F 13/30 165/151
4,550,776 A * 11/1985 Lu ..... F28F 1/325 165/151
4,621,687 A * 11/1986 Ikuta ..... F28F 1/128 165/152
4,676,304 A * 6/1987 Koisuka ..... F28D 1/0478 165/146
5,099,914 A * 3/1992 Reifel ..... F28F 1/325 165/151
5,176,020 A * 1/1993 Maruo ..... B21D 13/04 72/186
5,311,935 A 5/1994 Yamamoto et al.
5,669,438 A * 9/1997 Beales ..... F28F 1/128 165/152
2006/0266503 A1* 11/2006 Yamauchi ..... F28F 1/128 165/152
2007/0144714 A1* 6/2007 Yabe ..... F28D 1/0391 165/152

FOREIGN PATENT DOCUMENTS

JP 2004263881 A 9/2004
JP 2007178015 A 7/2007
JP 2011190966 A 9/2011

* cited by examiner

FIN FOR HEAT EXCHANGER

CROSS REFERENCE TO RELATED APPLICATIONS

This application is a U.S. National Phase Application under 35 U.S.C. 371 of International Application No. PCT/JP2014/003598 filed on Jul. 7, 2014 and published in Japanese as WO 2015/004899 A1 on Jan. 15, 2015. This application is based on and claims the benefit of priority from Japanese Patent Application No. 2013-146325 filed on Jul. 12, 2013. The entire disclosures of all of the above applications are incorporated herein by reference.

TECHNICAL FIELD

The present disclosure relates to a fin for a heat exchanger.

BACKGROUND ART

Up to now, a corrugated fin is employed as a fin for a heat exchanger, and multiple louvers are cut in and raised from a surface of the corrugated fin along an air flowing direction. A technique in which a heat exchanging performance is improved by changing specifications such as a width of the corrugated fin, fin pitches, or a length of the louvers has been variously proposed (for example, refer to Patent Document 1).

Incidentally, in the fin for the heat exchanger having the multiple louvers, when the louver pitches are miniaturized to increase the number of louvers, a heat transfer coefficient of the fin is improved by a tip effect of the louvers, and a heat transfer performance can be improved. In recent years, with an advance of manufacturing techniques, the louver pitches can be miniaturized more than conventional manufacturing limitation dimensions.

However, when the louver pitches are miniaturized, although the heat transfer coefficient is improved, the fin efficiency is reduced, and a heat flow rate emitted from the fin is reduced. This leads to a case in which as a real fin, an improvement in the heat transfer performance attributable to the miniaturization of the louver pitches cannot be sufficiently obtained. That is, in the heat exchanger fin having the multiple louvers, it is difficult to improve the heat transfer performance by merely miniaturizing the louver pitches.

PRIOR ART DOCUMENT

Patent Document

Patent Document 1: JP S61-46756

SUMMARY OF THE INVENTION

In view of the above, it is an objective of the present disclosure to provide a fin for a heat exchanger, which is capable of improving a heat transfer performance.

According to an aspect of the present disclosure, a fin for a heat exchanger is joined to an outer surface of a heat exchange object and facilitates a heat exchange between the heat exchange object and a fluid flowing around the heat exchange object. The fin includes flat portions substantially parallel to a flowing direction of the fluid, a ridge portion connecting adjacent two of the flat portions, and louvers disposed in the flat portions along a flowing direction of the fluid. The flat portions and the ridge portion are corrugated in a sectional surface perpendicular to the flowing direction of the fluid as a whole. The louvers are cut in and raised from the flat portions at a predetermined cut-and-raised angle. A thickness of each flat portion is defined as t, a louver pitch of the louvers is defined as PL, and the thickness of each flat portion and the louver pitch satisfy a relationship of $0.035 \leq t/PL \leq 0.29$.

According to the above configuration, when the thickness of the flat portion and the louver pitches fall within a range of $0.035 \leq t/PL \leq 0.29$, the improvement in the heat transfer performance of the fin for the heat exchanger due to the miniaturization of the louver pitches PL can be sufficiently obtained. For that reason, the heat transfer performance can be improved.

EMBODIMENTS FOR EXPLOITATION OF THE INVENTION

Figure 1:
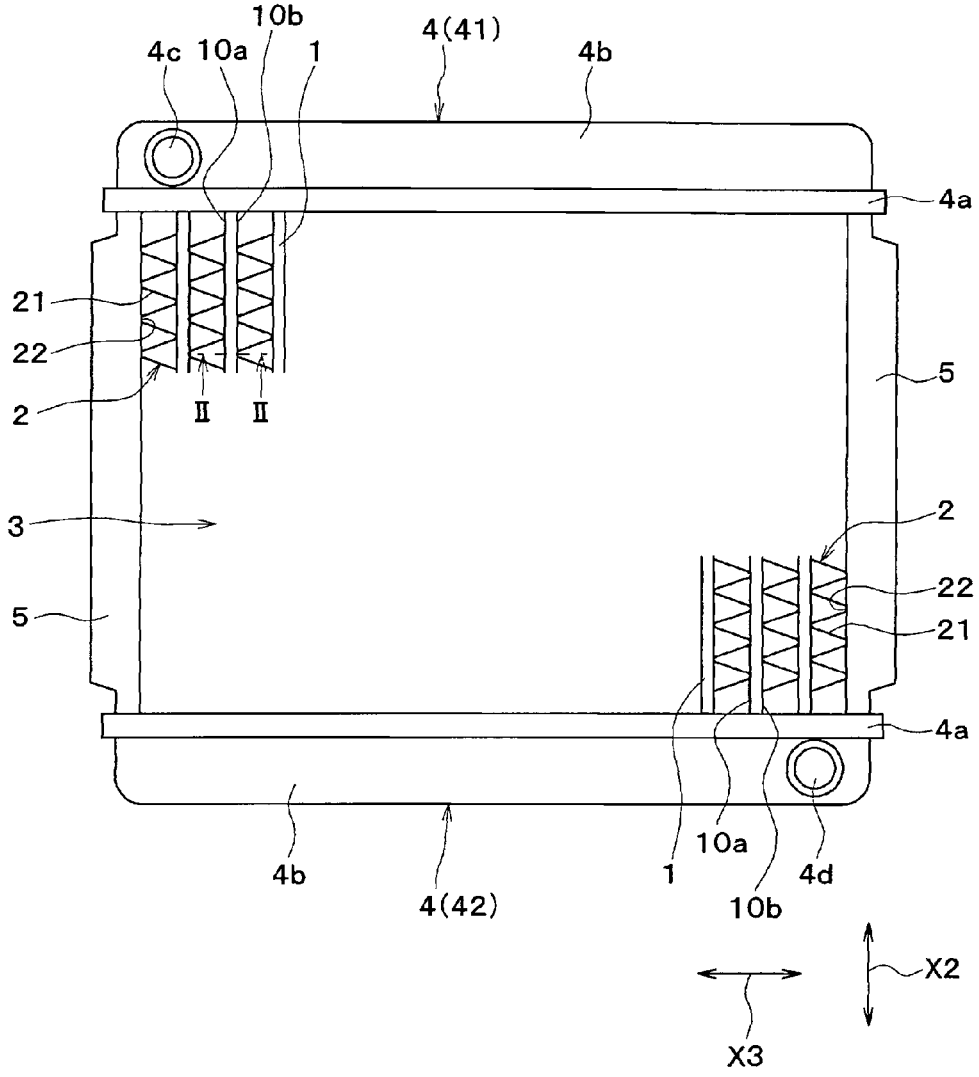
FIG. 1 is a schematic front view illustrating a radiator according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

Subsequently, a first embodiment of the present disclosure will be described with reference to FIG. 1 to FIG. 14. According to the present embodiment, a fin for a heat exchanger according to the present disclosure is applied to a fin having a heater core for heating a blast air with a coolant of a water-cooled internal combustion engine (hereinafter, referred to as an engine) as a heat source.

As illustrated in FIG. 1, the heater core includes tubes 1 which are tubes in which the coolant as an internal fluid flows. The tubes 1 are formed into a flat elliptical shape (flattened shape) in a cross-section perpendicular to a longitudinal direction of the tubes 1 so that a flowing direction of an air (hereinafter referred to as "air flowing direction X1") as an external fluid matches a major axis direction of the tubes. Multiple tubes 1 are arranged parallel to a horizontal direction so that the longitudinal direction of the tubes 1 matches a vertical direction.

Each of the tubes 1 has two flat surfaces 10*a* and 10*b* that face each other across a fluid passage in which the coolant flows in the tube 1. A fin 2 formed into a wave shape as a heat transfer member is joined to each of the flat surfaces 10*a* and 10*b* on both sides of the tube 1. The fins 2 allow a heat transfer area to the air to increase for facilitating a heat exchange between the coolant and the air. For that reason, the tube 1 corresponds to a heat exchange object of the present disclosure. Hereinafter, a substantially rectangular heat exchanging unit including the tubes 1 and the fins 2 is called "core portion 3".

Header tanks 4 communicate with the multiple tubes 1 on ends (in the present embodiment, upper and lower ends) of the longitudinal direction (hereinafter referred to as "tube longitudinal direction X2") of the tubes 1, and the header tanks 4 extend in a direction (in the present embodiment, a horizontal direction) orthogonal to the tube longitudinal direction X2. The header tanks 4 each include a core plate 4*a* into which the tubes 1 are inserted and joined, and a tank main body part 4*b* configuring a tank space together with the core plate 4*a*. In the present embodiment, the core plate 4*a* and the tank main body part 4*b* are made of metal (for example, aluminum alloy). Inserts 5 are disposed on both ends of the core portion 3, and the inserts 5 extend substantially parallel to the tube longitudinal direction X2, and reinforce the core portion 3.

An inlet pipe 4*c* is disposed in the tank main body part 4*b* of an inlet side tank 41, and allows the coolant that has cooled the engine to flow into the tank main body part 4*b*. The inlet side tank 41 is one of the two header tanks 4 disposed on an upper side, and branches the coolant into the tubes 1. An outlet pipe 4*d* is disposed in the tank main body part 4*b* of an outlet side tank 42, and allows the coolant that has been cooled by a heat exchange with the air to flow toward the engine. The outlet side tank 42 is one of the header tanks 4 disposed on a lower side, and gathers the coolant flowing out of the tubes 1.

Figure 2:
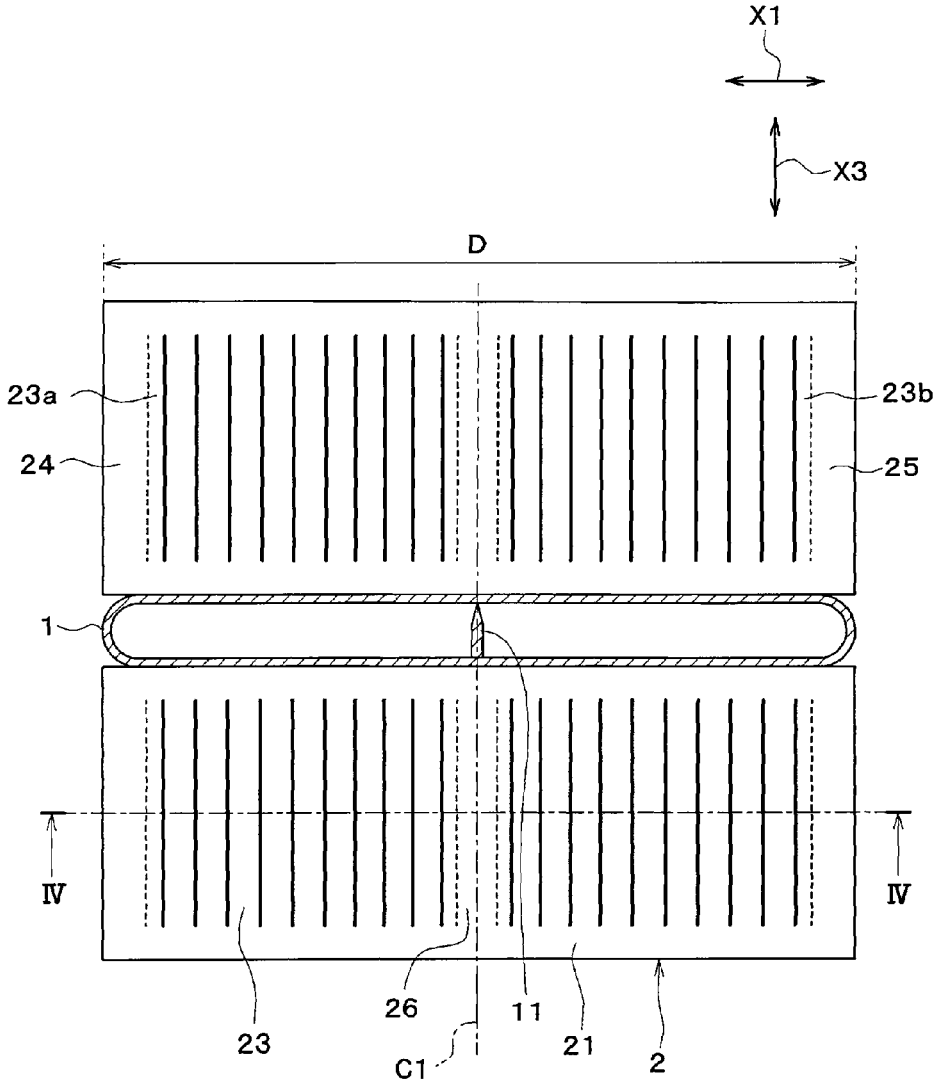
FIG. 2 is a sectional view taken along a line II-II in FIG. 1.

As illustrated in FIG. 2, an inner pillar part 11 is formed inside of each tube 1 so as to connect the two flat surfaces 10*a* and 10*b* to each other, and increases a pressure resistance of the tube 1. The inner pillar part 11 is disposed in the center of each tube 1 in an air flowing direction X1. A flow passage inside of the tube 1 is separated into two passages by the inner pillar part 11.

Figure 3:
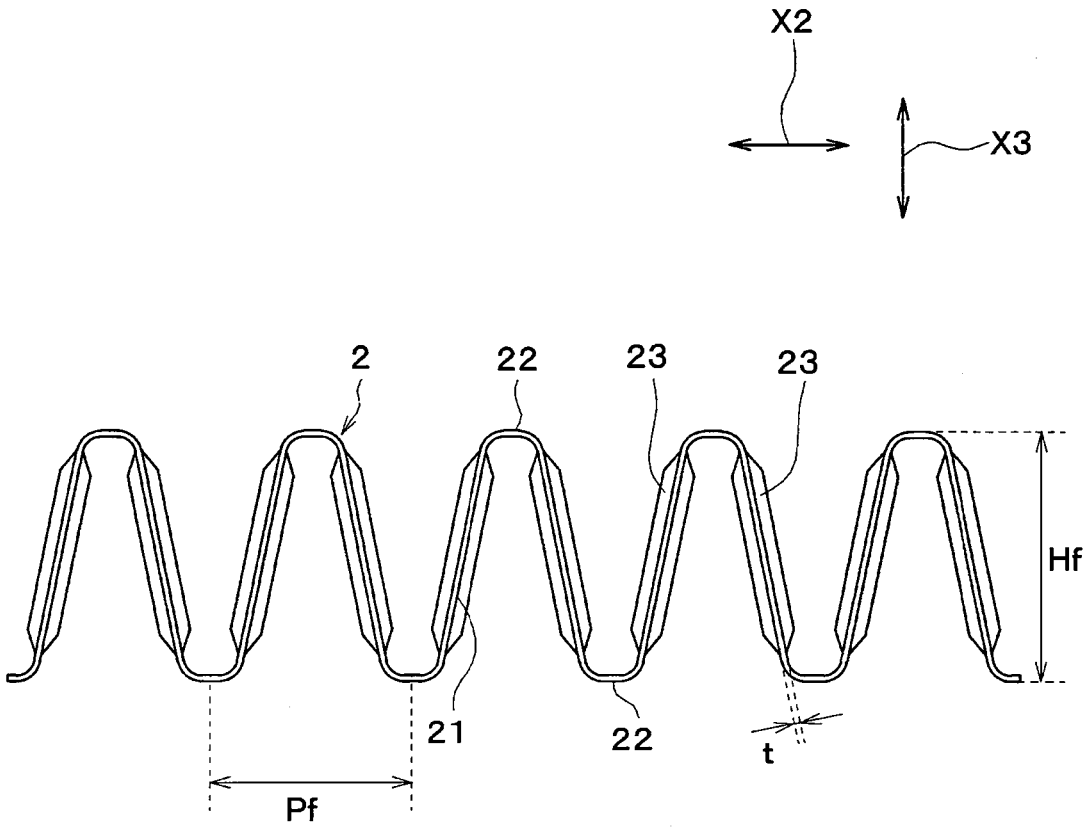
FIG. 3 is a front view illustrating a fin according to the first embodiment.

As illustrated in FIG. 3, each of the fins 2 is a corrugated fin formed in a waveform having plate-shaped flat portions 21 (plate parts) and ridge portions 22 positioning the adjacent flat portions 21 apart from each other by a predetermined distance. The flat portions 21 provide surfaces expanding along an air flowing direction X1 (direction perpendicular to a paper plane in FIG. 2). The flat portions 21 can be provided by flat plates.

The ridge portions 22 each have a flat top plate part provided to face a flat surface having a narrow width outward. A bent part substantially at a right angle is disposed between the top plate part and the flat portion 21. Each top plate part is joined to the tube 1, and the fins 2 and the tubes 1 are joined to each other in a thermally transferable manner. When each of the ridge portions 22 is formed to be sufficiently narrow in a width of the top plate part, and formed with the bent part having a large radius, the ridge portion 22 can be viewed as a curved part curved as a whole. Hence, in the following description, the ridge portions 22 can be also called "curved parts".

In the present embodiment, the corrugated fins 2 are shaped by subjecting a thin plate metal material to a roll forming method. The curved parts (22) of the fins 2 are joined to the flat surfaces 10*a* and 10*b* of the tubes 1 by brazing.

Figure 4:
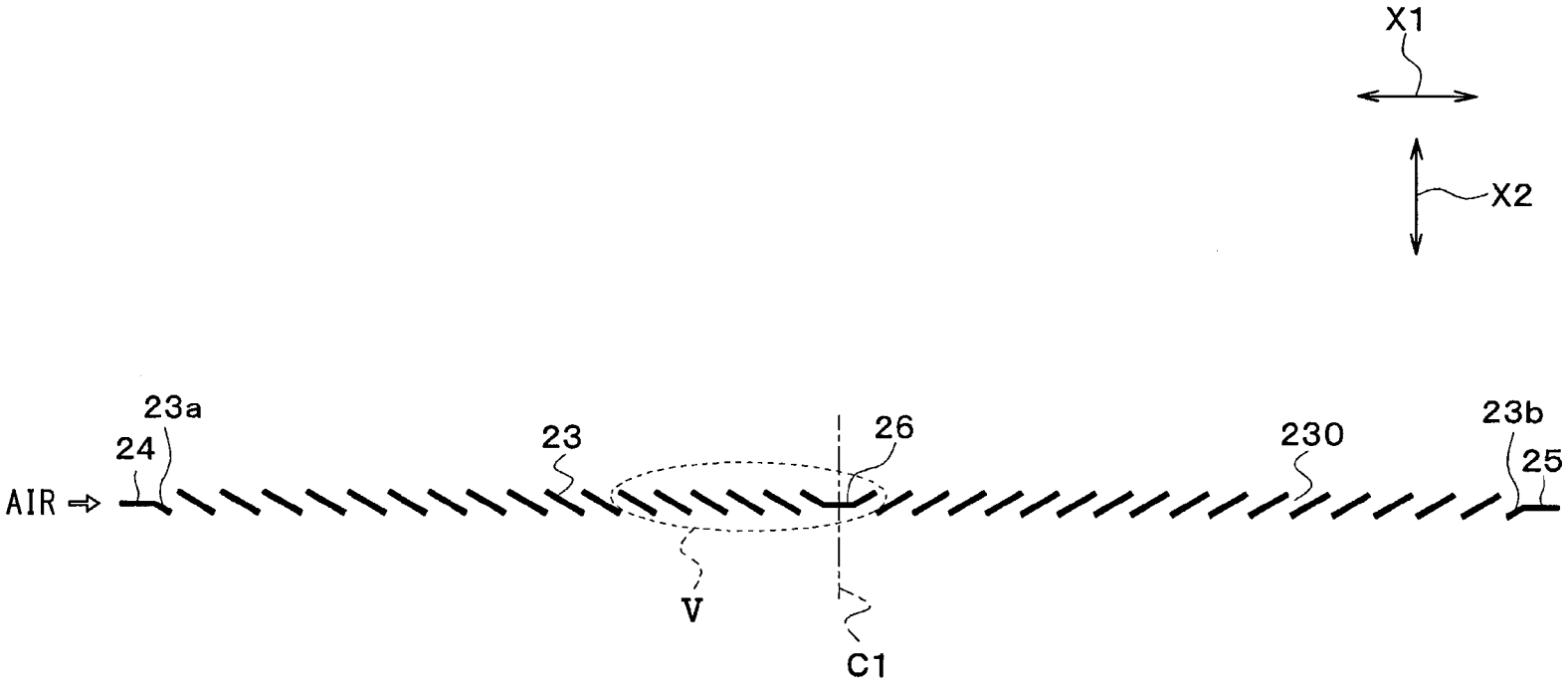
FIG. 4 is a sectional view taken along a line IV-IV in FIG. 2.
Figure 5:
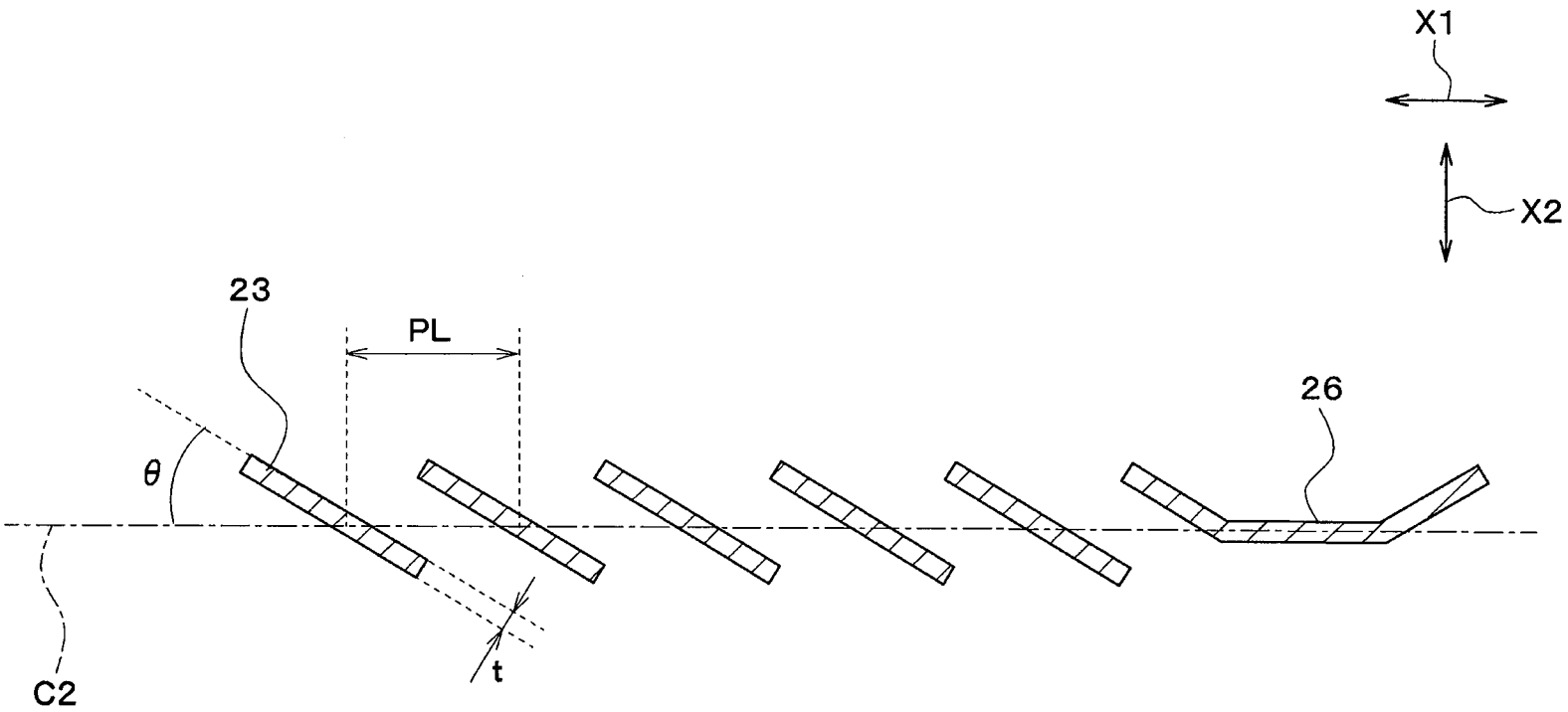
FIG. 5 is a diagram illustrating a portion V in FIG. 4.

As illustrated in FIGS. 4 and 5, louver-shaped louvers 23 are formed integrally seamlessly in each of the flat portions 21 of the fins 2 by cutting and raising the flat portion 21. When viewed from a stacking direction X3 of the tubes 1 (hereinafter referred to as "tube stacking direction X3"), the louvers 23 are cut in and raised from each of the flat portions 21 at a predetermined angle (hereinafter referred to as "cut-and-raised angle θ"). The multiple louvers 23 are disposed in each of the flat portions 21 in the air flowing direction X1. An inter-louver passage 230 in which air can flow is defined between the adjacent louvers 23.

In the present embodiment, the multiple louvers 23 formed in each of the flat portions 21 are bisected into an upstream louver group having the multiple louvers 23 located on an air flow upstream side, and a downstream louver group having the multiple louvers 23 located on an air flow downstream side. A cut-and-raised direction of the louvers 23 belonging to the upstream louver group is different from a cut-and-raised direction of the louvers 23 belonging to the downstream louver group. In other words, the upstream louver group and the downstream louver group are formed in such a manner that the cut-and-raised directions of the louvers 23 belonging to the respective groups are opposite to each other.

An end of each flat portion 21 on the air flow upstream side is provided with an upstream flat portion 24 in which no louver 23 is formed. Likewise, an end of each flat portion 21 on the air flow downstream side is provided with a downstream flat portion 25 in which no louver 23 is formed.

No louver 23 is formed substantially in the center of each flat portion 21 in the air flowing direction X1, that is, between the upstream louver group and the downstream louver group, and configured as a turning part 26 in which the air flowing direction is reversed. In other words, the turning part 26 is disposed between the upstream louver group and the downstream louver group, and formed substantially parallel to the air flowing direction X1. The upstream louver group and the downstream louver group are reversed in the cut-and-raised directions of the louvers 23 belonging to the respective groups through the turning part 26.

An upstream end louver 23*a* of the multiple louvers 23, which is disposed on a most upstream side in the air flow, is connected to the upstream flat portion 24. A downstream end louver 23*b* of the multiple louvers 23, which is disposed on a most downstream side in the air flow, is connected to the downstream flat portion 25.

The louvers 23 are disposed on the air flow upstream side and the air flow downstream side of the turning part 26 in equal number. The multiple louvers 23 are arranged symmetrically with respect to a center line (virtual line) C1 of the flat portions 21 in the air flowing direction. In FIG. 5, a two-dot chain line indicates a center line (virtual line) C2 in a thickness direction of the fin 2.

Figure 6:
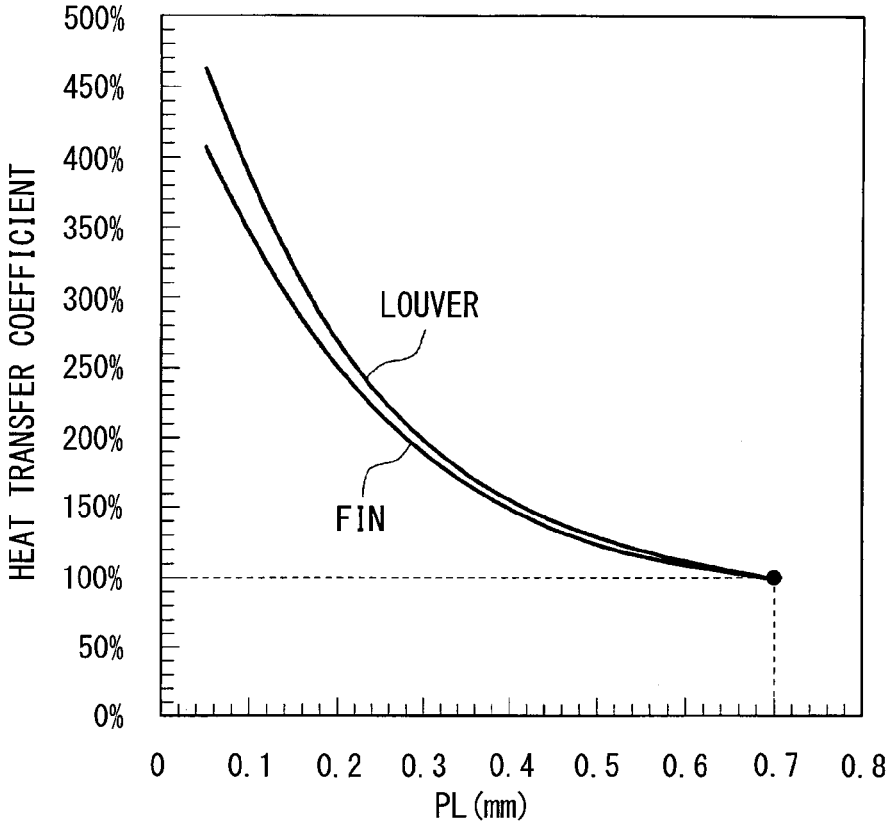
FIG. 6 is a characteristic diagram illustrating changes in the heat transfer coefficient of louvers and the heat transfer coefficient of a fin depending on louver pitches according to the first embodiment.

A change in the heat transfer coefficient of the louvers 23 and the heat transfer coefficient of the fin 2 when changing louver pitches PL of the louvers 23 are illustrated in FIG. 6. The axis of ordinate in FIG. 6 represents the heat transfer coefficient of the louvers 23 and the heat transfer coefficient of the fins 2 when the heat transfer coefficient of the fin 2 (hereinafter referred to as "reference fin") that is the existing fin 2 whose louver pitch PL is 0.7 mm is 100%.

A thickness t of the reference fin is 0.05 mm. In the present embodiment, the thickness t of the fins 2 means the thickness of the flat portions 21 of the fins 2, and is equal to the thickness of the louvers 23.

As illustrated in FIG. 6, in the fins 2, the heat transfer coefficient of the louvers 23 is improved more as the louver pitches PL of the louvers 23 are smaller. However, since the fin efficiency is lowered more as the louver pitches PL are smaller, an increase effect in the heat transfer coefficient of the fins 2 attributable to the miniaturization of the louver pitches PL cannot be sufficiently obtained. Further, as is apparent from FIG. 6, a difference between the heat transfer coefficient of the louvers 23 and the heat transfer coefficient (louver heat transfer coefficient×fin coefficient) of the fins 2 becomes larger as the louver pitches PL are smaller.

Figure 7:
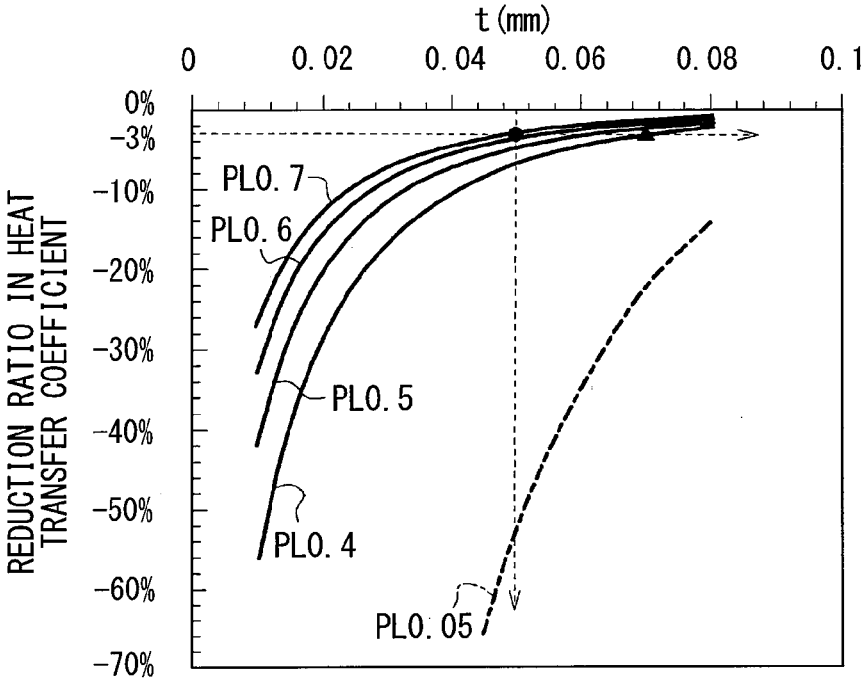
FIG. 7 is a characteristic diagram illustrating a relationship between the thickness of the fin and a reduction ratio of the heat transfer coefficient of the fin to the heat transfer coefficient of the louvers according to the first embodiment.

Subsequently, a relationship between the thickness t of the fins 2 and a reduction ratio of the heat transfer coefficient of the fins 2 to the heat transfer coefficient of the louvers 23 in the fins 2 different in the louver pitches PL is illustrated in FIG. 7. In the reference fin, the reduction ratio of the heat transfer coefficient of the fins 2 to the heat transfer coefficient of the louvers 23 is 3%.

As illustrated in FIG. 7, the difference between the heat transfer coefficient of the louvers 23 and the heat transfer coefficient of the fins 2 becomes larger as the thickness t of the fins 2 is smaller. For that reason, when the louver pitches PL are set to be smaller, in order to maintain the reduction ratio of the heat transfer coefficient of the fins 2 to the heat transfer coefficient of the louvers 23 equal to the reference fin, there is a need to relatively thicken the thickness t of the fins 2 as compared with the louver pitches PL.

Figure 8:
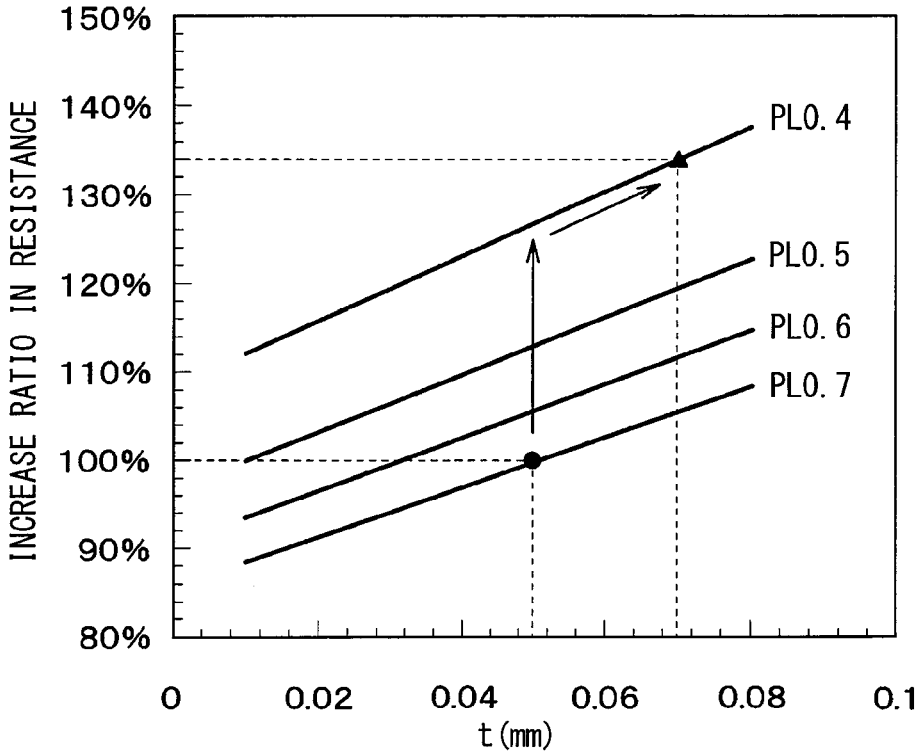
FIG. 8 is a characteristic diagram illustrating a relationship between the thickness of the fin and a ventilation resistance according to the first embodiment.

Subsequently, a relationship between the thickness t and a ventilation resistance of the fins 2 in the fins 2 different in the louver pitches PL is illustrated in FIG. 8. The axis of ordinate of FIG. 8 represents an increase ratio of the ventilation resistance when the ventilation resistance of the reference fin is set to 100%. As illustrated in FIG. 8, the ventilation resistance increases more as the thickness t of the fins 2 is larger.

Under the circumstances, the present inventors have studied the heat transfer performance of the fins 2 when the louver pitches PL are miniaturized taking the heat transfer coefficient and the ventilation resistance into account.

In this case, when a Nusselt number is Nu, the heat transfer coefficient of the fins 2 is $\alpha$, the fin pitch of the fins 2 is Pf (refer to FIG. 3), the heat transfer coefficient of an air is $\lambda a$, the resistance coefficient is Cf, the ventilation resistance is $\Delta Pa$, an air density is pa, an air velocity is Ua, and the width of the fins 2, that is, a length of the fins 2 in the air flowing direction X1 is D (refer to FIG. 2), the Nusselt number and the resistance coefficient are represented by the following mathematical expressions 1 and 2, respectively.

$$Nu=\alpha*Pf/\lambda a \quad \text{(Expression 1)}$$

$$Cf=\Delta Pa/(0.5*\rho a*Ua^2Pf/D) \quad \text{(Expression 2)}$$

In the present embodiment, a ratio (Nu/Cf) of the Nusselt number Nu and the resistance coefficient Cf is used as an index of the heat transfer coefficient of the fins 2. The index represents that the heat transfer coefficient of the fins 2 is higher as a value of Nu/Cf is larger. It is defined that the Nusselt number Nu is $Nu_0$ and the resistance coefficient is $Cf_0$ in fins 2 of a comparative example where no louver 23 is formed in the flat portions 21 of the fins 2.

Figure 9:
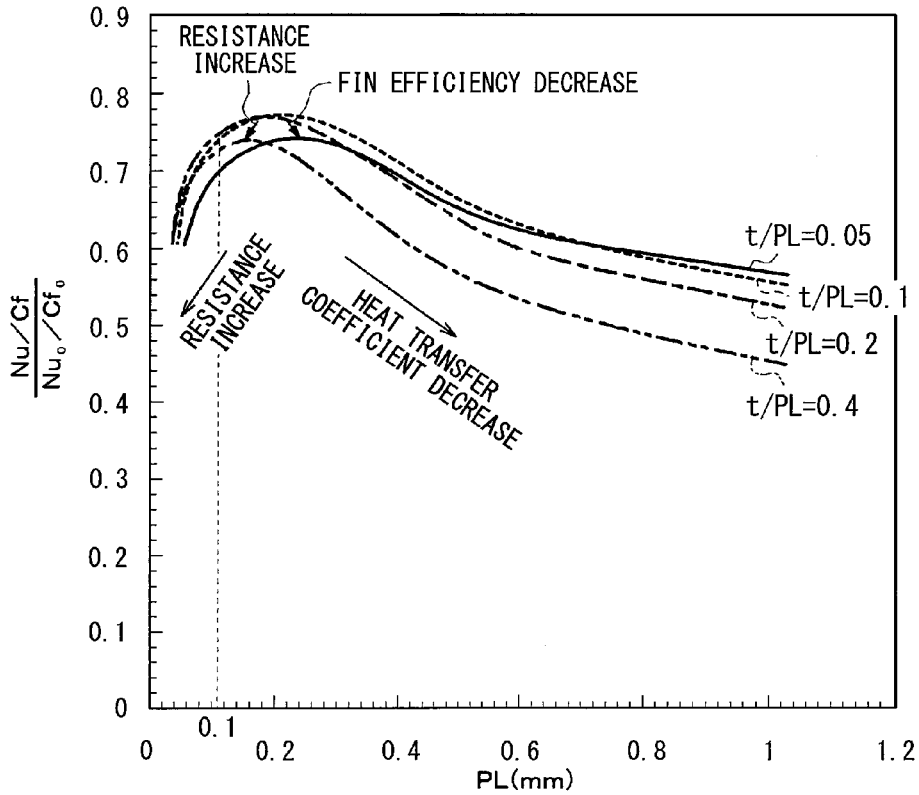
FIG. 9 is a characteristic diagram illustrating a change in a heat transfer performance of the fin when the specifications of the fin are changed according to the first embodiment.

A change in the heat transfer performance of the fins 2 when the specifications of the fins 2 are changed is illustrated in FIG. 9. The axis of abscissa in FIG. 9 illustrates the louver pitches PL. The axis of ordinate in FIG. 9 represents Nu/Cf of the fins 2 in the present embodiment to $Nu_0/Cf_0$ of the fins 2 in the comparative example, and represents that the heat transfer performance of the fins 2 is higher as a value of the axis of ordinate is larger.

Specifically, the heat transfer performance of the fins 2, that is, $(Nu/Cf)/(Nu_0/Cf_0)$ with respect to the respective louver pitches PL when t/PL is kept constant, and the fin height Hf (refer to FIG. 3) is 1.0, 2.0, 3.0, 4.0, and 5.0 (unit: mm) is calculated. In the five kinds of fin heights Hf, values when the heat transfer performance $((Nu/Cf)/(Nu_0/Cf_0))$ of the fins 2 are plotted to create a graph curve.

Referring to FIG. 9, a solid line represents the heat transfer performance when t/PL is 0.05, a broken line represents the heat transfer performance when t/PL is 0.1, an alternate long and short dash line represents the heat transfer performance when t/PL is 0.2, and a two-dot chain line represents the heat transfer performance when t/PL is 0.4.

As is apparent from FIG. 9, when the louver pitch PL is equal to or smaller than 0.1 mm, an increase in the ventilation resistance causes the heat transfer performance of the fins 2 to be reduced regardless of the thickness t of the fins 2. When the thickness t of the fins 2 is relatively small (t/PL is smaller than 1.0), a decrease in the fin efficiency causes a maximum value of the heat transfer performance of the fins 2 to be reduced. On the other hand, when the thickness t of the fins 2 is relatively large (t/PL is larger than 1.0), an increase in the ventilation resistance causes a maximum value of the heat transfer performance of the fins 2 to be reduced. Therefore, when t/PL is set to about 0.1, a maximum value of the heat transfer performance of the fins 2 becomes largest, which is desirable.

Figure 10:
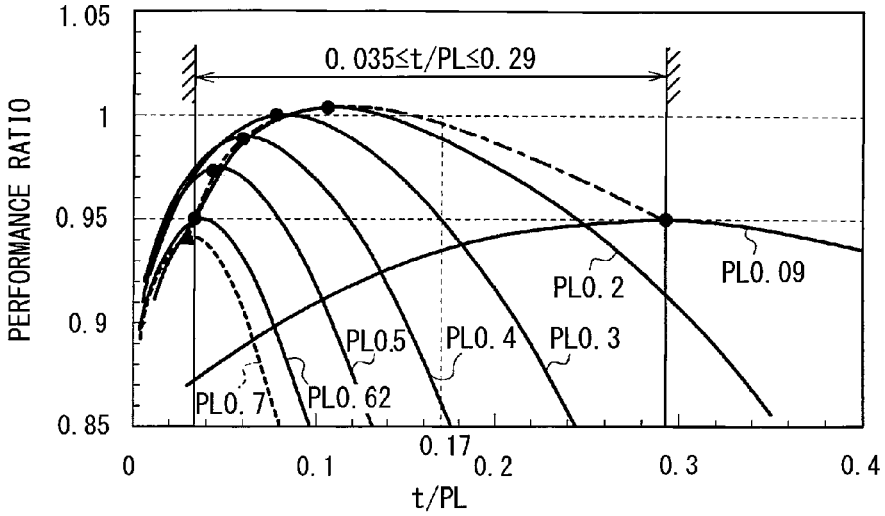
FIG. 10 is a characteristic diagram illustrating a relationship between the louver pitches and the thickness of the fin, and the heat transfer performance of the fin in a heater core according to the first embodiment.

In the heater core according to the present embodiment, a relationship between t/PL when the louver pitches PL are changed and a heat transfer performance of the fins 2 is illustrated in FIG. 10. In this situation, a size of the heater core is 200 mm in a lateral direction, 150 mm in a longitudinal direction, and 16 mm in a width direction, and a flow rate of air passing through the heater core is 300 $m^3$/h, an air temperature is 20° C., and a coolant temperature is 85° C. A fin height Hf is 3 mm, and the cut-and-raised angle θ of the louvers 23 is 32°.

The axis of ordinate in FIG. 10 represents a heat transfer performance ratio of the respective fins 2 when a maximum value of the heat transfer performance of the fins 2 whose louver pitches PL are 0.3 mm is 100%. A broken line in FIG. 10 represents a heat transfer performance of the fins 2 whose t/PL is 0.03.

Referring to FIG. 10, black dot plots represent a maximum value of the heat transfer performance of the respective fins 2 different in the louver pitches PL, and an alternate short and long dash line is a graph curve that passes through the black dot plots. Referring to FIG. 10, black triangular plots represent a maximum value of the heat transfer performance of the fins 2 whose t/PL is 0.03.

As described above, when t/PL is set to about 0.1, the maximum value of the heat transfer performance of the fins 2 (hereinafter referred to as "fin heat transfer performance maximum value") becomes largest. However, as illustrated in FIG. 10, when t/PL is equal to or larger than 0.035 and equal to or smaller than 0.29, the heat transfer performance that is equal to or larger than 95% of the fin heat transfer performance maximum value can be ensured. In other words, when t/PL is equal to or larger than 0.035 and equal to or smaller than 0.29, the improvement in the heat transfer performance of the fins 2 attributable to the miniaturization of the louver pitches PL can be sufficiently obtained.

Figure 11:
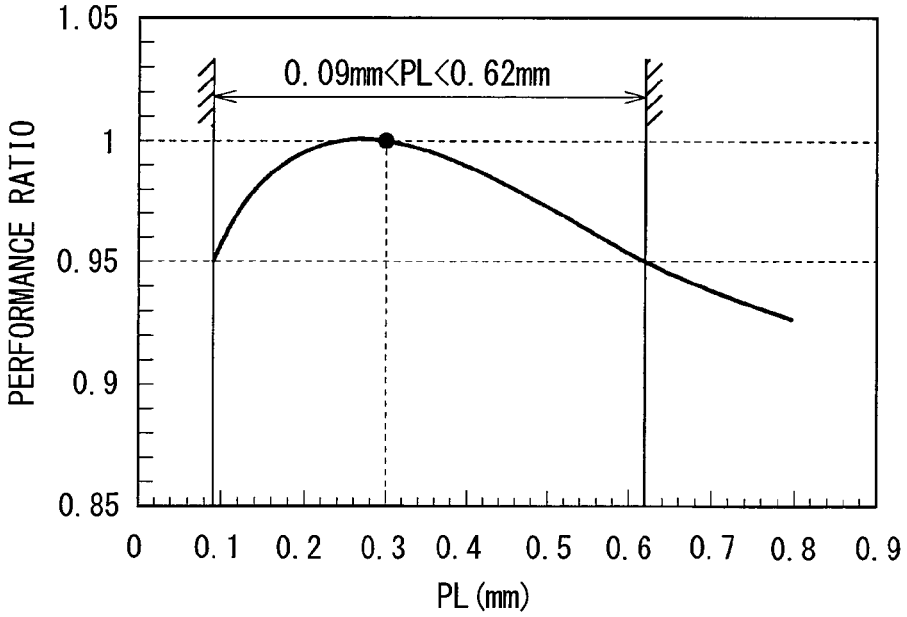
FIG. 11 is a characteristic diagram illustrating a relationship between the louver pitches and the heat transfer performance of the fin in the heater core according to the first embodiment.

A relationship between the louver pitches PL and the heat transfer performance of the fins 2 in the heater core according to the present embodiment is illustrated in FIG. 11. In this case, the conditions are identical with those in FIG. 10 except that the thickness t of the fins 2 in the heater core is set to 0.03 mm. The axis of ordinate in FIG. 11 represents a heat transfer performance ratio of the fins 2 when the heat transfer performance of the fins 2 whose louver pitches PL are 0.3 mm is set to 100%.

As illustrated in FIG. 11, when the louver pitches PL are set to be larger than 0.09 mm, and smaller than 0.62 mm, the heat transfer performance that is equal to or larger than 95% of the fin heat transfer performance maximum value can be ensured.

Figure 12:
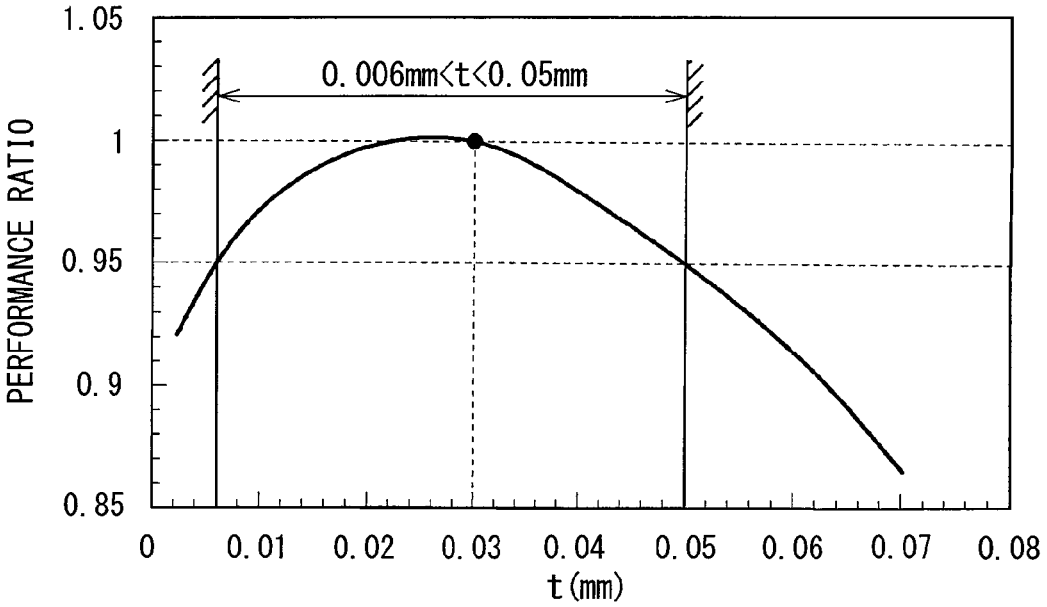
FIG. 12 is a characteristic diagram illustrating a relationship between the thickness of the fin and the heat transfer performance of the fin in the heater core according to the first embodiment.

A relationship between the thickness t of the fins 2 and the heat transfer performance of the fins 2 in the heater core according to the present embodiment is illustrated in FIG. 12. In this case, the conditions are identical with those in FIG. 10 except that the louver pitches PL in the heater core are set to 0.3 mm. The axis of ordinate in FIG. 12 represents a heat transfer performance ratio of the fins 2 when the heat transfer performance of the fins 2 whose thickness t is 0.03 mm is set to 100%.

As illustrated in FIG. 12, when the thickness t of the fins 2 is set to be larger than 0.006 mm, and smaller than 0.05 mm, the heat transfer performance that is equal to or larger than 95% of the fin heat transfer performance maximum value can be ensured. It is preferable that the thickness t of the fins 2 is set to be larger than 0.006 mm, and smaller than 0.04 mm.

Figure 13:
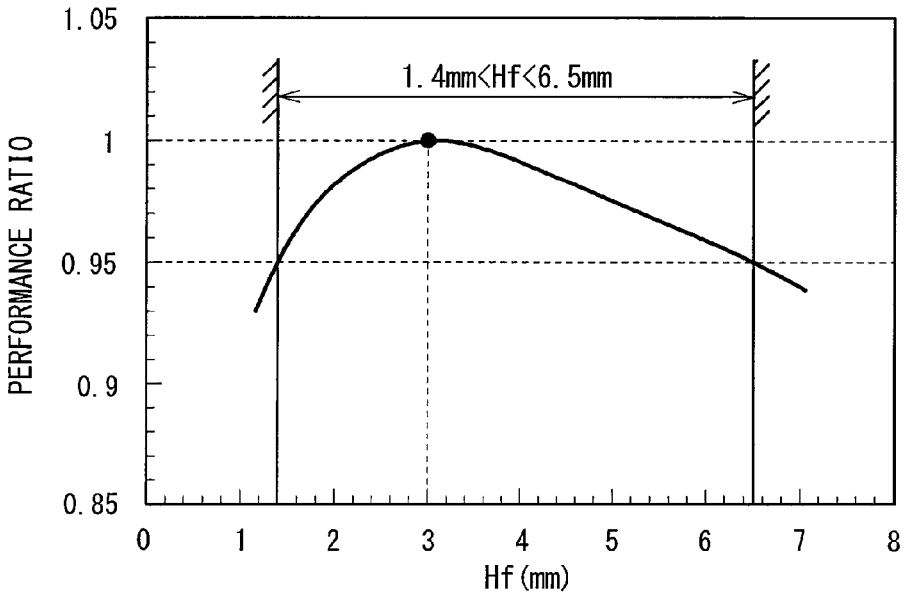
FIG. 13 is a characteristic diagram illustrating a relationship between a fin height and the heat transfer performance of the fin in the heater core according to the first embodiment.

A relationship between the fin height Hf and the heat transfer performance of the fins 2 in the heater core according to the present embodiment is illustrated in FIG. 13. In this case, the conditions are identical with those in FIG. 10 except that the louver pitches PL in the heater core are set to 0.3 mm, and the thickness t of the fins 2 is set to 0.03 mm. The axis of ordinate in FIG. 13 represents a heat transfer performance ratio of the fins 2 when the heat transfer performance of the fins 2 whose fin height Hf is 3 mm is set to 100%.

As illustrated in FIG. 13, when the fin height Hf is set to be larger than 1.4 mm, and smaller than 6.5 mm, the heat transfer performance that is equal to or larger than 95% of the fin heat transfer performance maximum value can be ensured.

Figure 14:
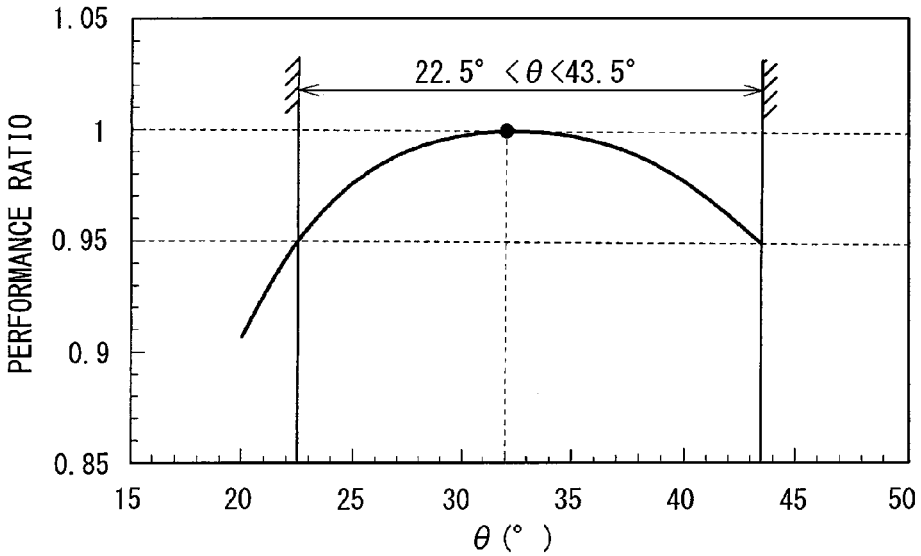
FIG. 14 is a characteristic diagram illustrating a relationship between a cut-and-raised angle of the louvers and the heat transfer performance of the fin in the heater core according to the first embodiment.

A relationship between the cut-and-raised angle θ of the louvers 23 and the heat transfer performance of the fins 2 in the heater core according to the present embodiment is illustrated in FIG. 14. In this case, the conditions are identical with those in FIG. 10 except that the louver pitches PL in the heater core are set to 0.3 mm, and the thickness t of the fins 2 is set to 0.03 mm. The axis of ordinate in FIG. 14 represents a heat transfer performance ratio of the fins 2 when the heat transfer performance of the fins 2 in which the cut-and-raised angle θ of the louvers 23 is 32° is set to 100%.

As illustrated in FIG. 14, when the cut-and-raised angle θ of the louvers 23 is set to be larger than 22.5°, and smaller than 43.5°, the heat transfer performance that is equal to or larger than 95% of the fin heat transfer performance maximum value can be ensured.

As described above, when the thickness t of the flat portion 21 of the fins 2 and the louver pitches PL fall within a range of $0.035 \leq t/PL \leq 0.29$, the improvement in the heat transfer performance of the fins 2 attributable to the miniaturization of the louver pitches PL can be sufficiently obtained. For that reason, the heat transfer performance of the fins 2 can be improved.

It is desirable that the thickness t of the flat portion 21 of the fins 2 and the louver pitches PL fall within a range of $0.035 \leq t/PL \leq 0.17$. In this case, as illustrated in FIG. 10, when the louver pitches PL are set to be larger than 0.3 mm, and smaller than 0.62 mm, the heat transfer performance of the fins 2 can be further improved.

(Second Embodiment)

Subsequently, a second embodiment of the present disclosure will be described with reference to FIGS. 15 to 18. A second embodiment is different from the above first embodiment in that the fin for a heat exchanger according to the present disclosure is applied to a fin mounted on a radiator that performs a heat exchange between a coolant that has cooled a water-cooled internal combustion engine and an air.

Figure 15:
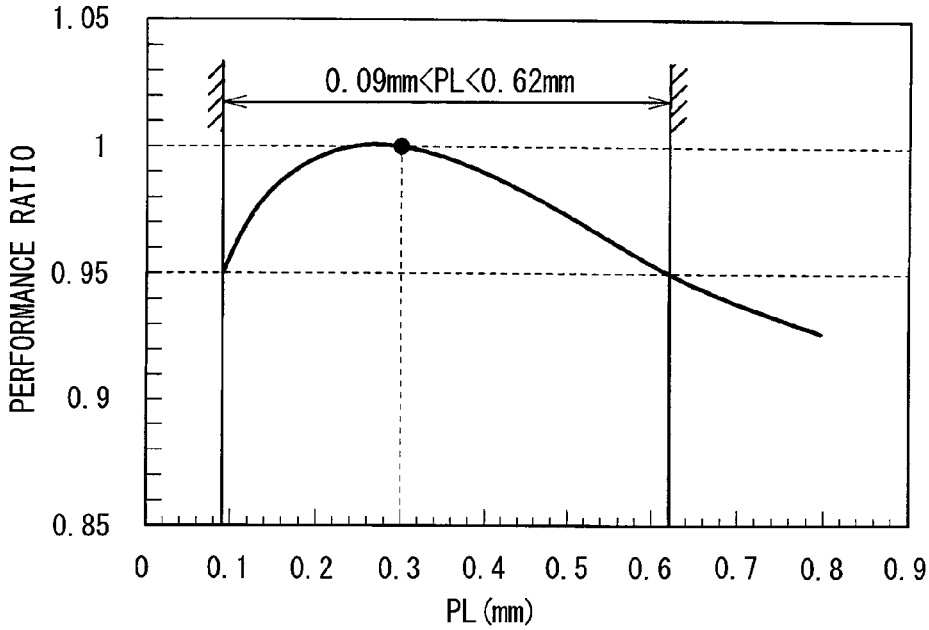
FIG. 15 is a characteristic diagram illustrating a relationship between louver pitches and the heat transfer performance of a fin in a radiator according to a second embodiment of the present disclosure.

A relationship between the louver pitches PL and the heat transfer performance of the fins 2 in the radiator according to the present embodiment is illustrated in FIG. 15. In this situation, a size of the radiator is 313 mm in a lateral direction, 400 mm in a longitudinal direction, and 16 mm in a width direction, and a flow rate of air passing through the radiator is 4 m/s, an air temperature is 20° C., and a coolant temperature is 80° C. A fin height Hf is 3 mm, a thickness t of the fins 2 is 0.03 mm, and the cut-and-raised angle θ of the louvers 23 is 32°. The axis of ordinate in FIG. 15 represents a heat transfer performance ratio of the fins 2 when the heat transfer performance of the fins 2 whose louver pitches PL are 0.3 mm is set to 100%.

As illustrated in FIG. 15, when the louver pitches PL are set to be larger than 0.09 mm, and smaller than 0.62 mm, the heat transfer performance that is equal to or larger than 95% of the fin heat transfer performance maximum value can be ensured.

Figure 16:
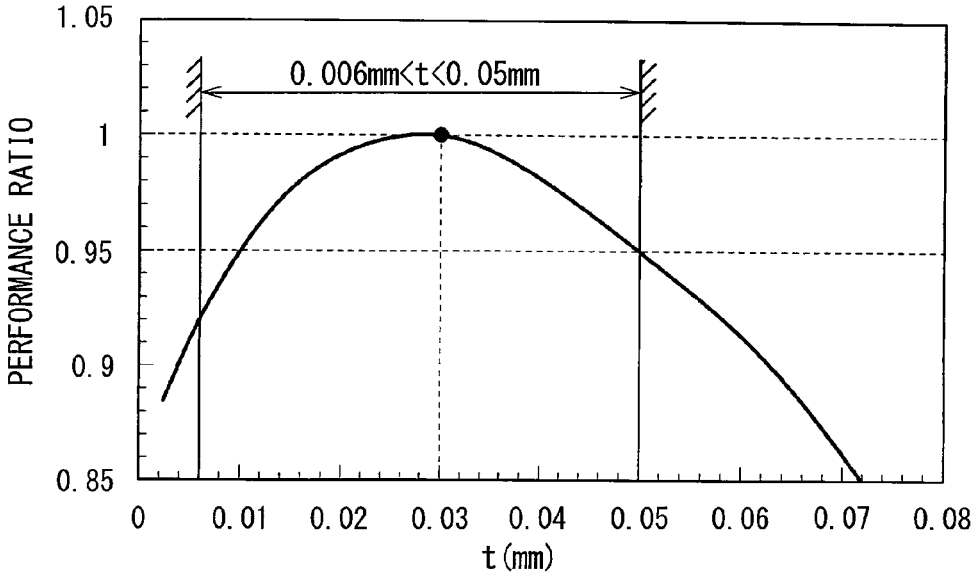
FIG. 16 is a characteristic diagram illustrating a relationship between the thickness of the fin and the heat transfer performance of the fin in the radiator according to the second embodiment.

A relationship between the thickness t of the fins 2 and the heat transfer performance of the fins 2 in the radiator according to the present embodiment is illustrated in FIG. 16. In this case, the conditions are identical with those in FIG. 15 except that the louver pitches PL in the radiator are set to 0.3 mm. The axis of ordinate in FIG. 16 represents a heat transfer performance ratio of the fins 2 when the heat transfer performance of the fins 2 whose thickness t is 0.03 mm is set to 100%.

As illustrated in FIG. 16, when the thickness t of the fins 2 is set to be larger than 0.006 mm, and smaller than 0.05 mm, the heat transfer performance that is equal to or larger than 95% of the fin heat transfer performance maximum value can be ensured.

Figure 17:
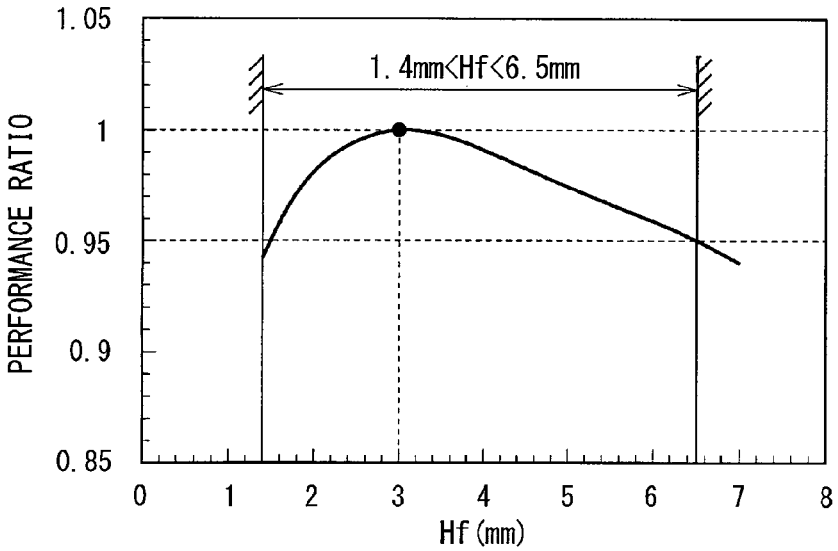
FIG. 17 is a characteristic diagram illustrating a relationship between a fin height and the heat transfer performance of the fin in the radiator according to the second embodiment.

A relationship between the fin height Hf and the heat transfer performance of the fins 2 in the radiator according to the present embodiment is illustrated in FIG. 17. In this case, the conditions are identical with those in FIG. 15 except that the louver pitches PL in the radiator are set to 0.3 mm, and the thickness t of the fins 2 is set to 0.03 mm. The axis of ordinate in FIG. 17 represents a heat transfer performance ratio of the fins 2 when the heat transfer performance of the fins 2 whose fin height Hf is 3 mm is set to 100%.

As illustrated in FIG. 17, when the fin height Hf is set to be larger than 1.4 mm, and smaller than 6.5 mm, the heat transfer performance that is equal to or larger than 95% of the fin heat transfer performance maximum value can be ensured.

Figure 18:
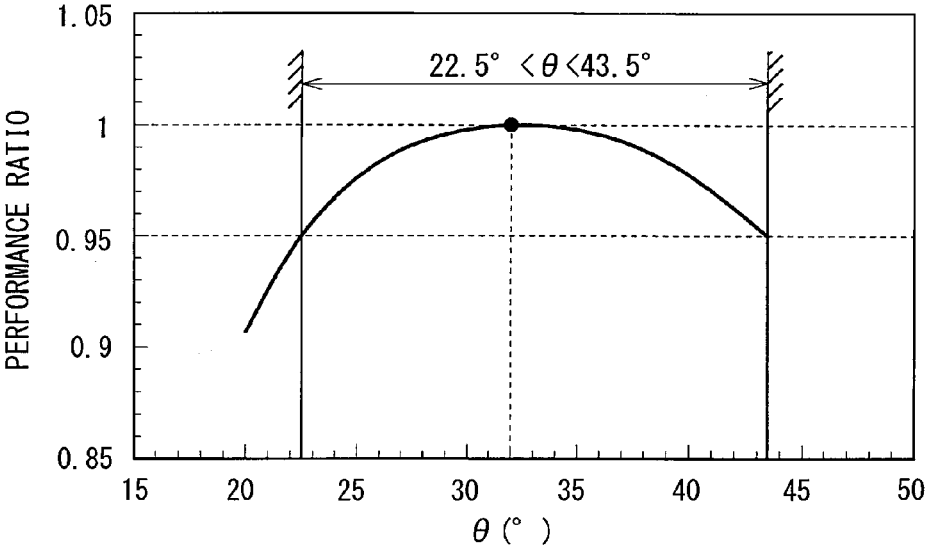
FIG. 18 is a characteristic diagram illustrating a relationship between a cut-and-raised angle of the louvers and the heat transfer performance of the fin in the radiator according to the second embodiment.

A relationship between the cut-and-raised angle θ of the louvers 23 and the heat transfer performance of the fins 2 in the radiator according to the present embodiment is illustrated in FIG. 18. In this case, the conditions are identical with those in FIG. 15 except that the louver pitches PL in the radiator are set to 0.3 mm, and the thickness t of the fins 2 is set to 0.03 mm. The axis of ordinate in FIG. 14 represents a heat transfer performance ratio of the fins 2 when the heat transfer performance of the fins 2 in which the cut-and-raised angle θ of the louvers 23 is 32° is set to 100%.

As illustrated in FIG. 18, when the cut-and-raised angle θ of the louvers 23 is set to be larger than 22.5°, and smaller than 43.5°, the heat transfer performance that is equal to or larger than 95% of the fin heat transfer performance maximum value can be ensured.

As described above, even when the fin mounted on the radiator is employed as the heat exchanger fin of the present disclosure, the same advantages as those in the above first embodiment can be obtained.

(Third Embodiment)

Subsequently, a third embodiment of the present disclosure will be described with reference to FIG. 19. The third embodiment is different from the first embodiment described above in the shape of the louvers 23.

Figure 19:
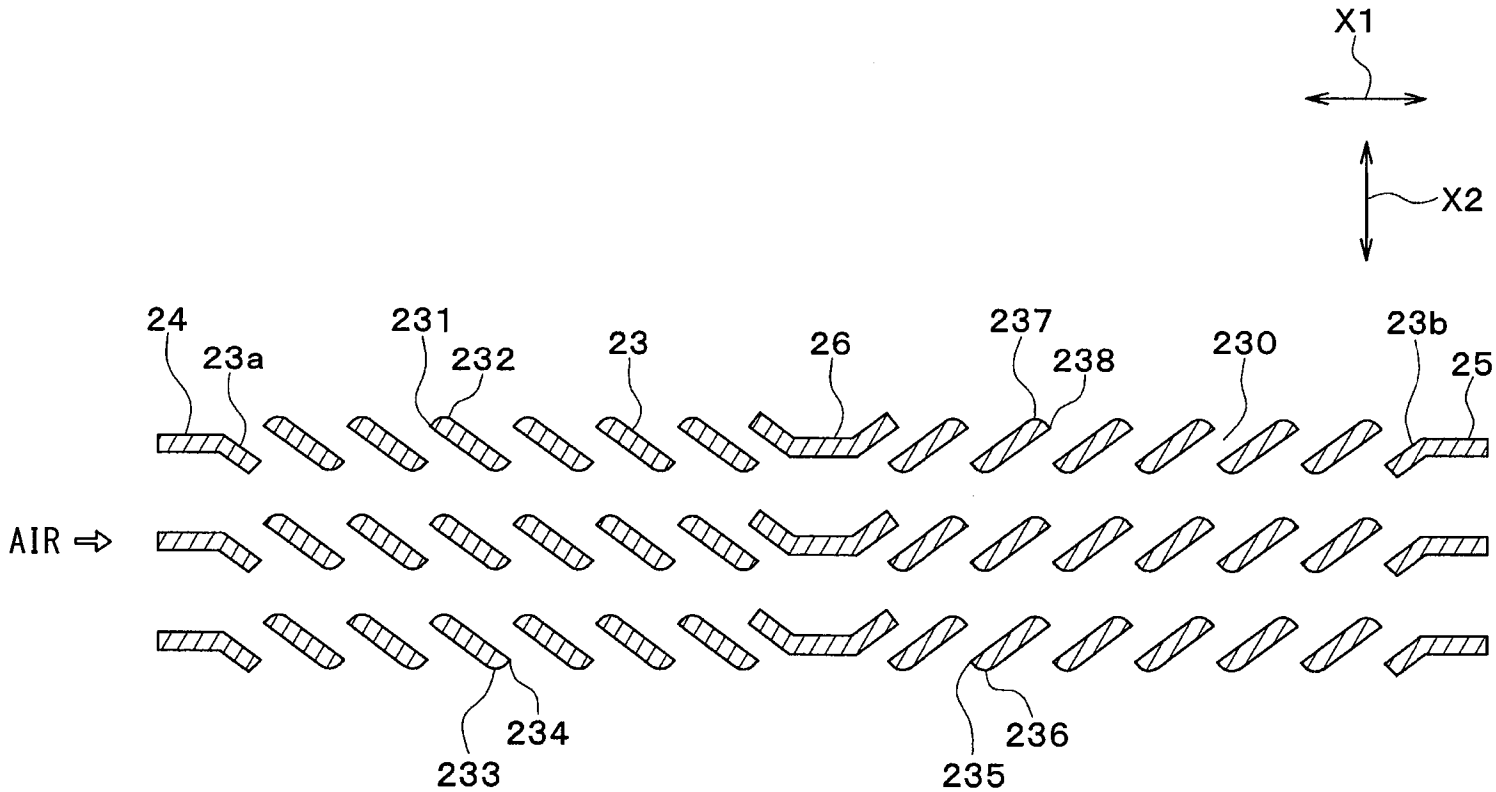
FIG. 19 is a sectional view illustrating a sectional surface perpendicular to a flat portion of a fin and parallel to an air flowing direction according to a third embodiment of the present disclosure.

As illustrated in FIG. 19, in all of louvers 23 formed in flat portions 21 of each fin 2, a shape in a sectional surface perpendicular to the flat portion 21 and parallel to the air flowing direction has arc shapes in regions corresponding to two corners of a rectangle. In the present embodiment, the shape of each louver 23 in the sectional surface perpendicular to the flat portion 21 and parallel to the air flowing direction has the arc shapes in the regions corresponding to two of four corners of the rectangle that are positioned on a diagonal line of the rectangle, and the other two corners are formed to be right-angled.

In more detail, in each of the louvers 23 belonging to an upstream louver group, in the sectional surface perpendicular to the flat portions 21 and parallel to the air flowing direction, a corner 232 on a side closer to a turning part 26 in two corners 231 and 232 (two corners on an upper side of a paper plane) of the rectangle on the air flow upstream side is arc-shaped. In each of the louvers 23 belonging to the upstream louver group, in the sectional surface perpendicular to the flat portions 21 and parallel to the air flowing direction, a corner 233 on a side farther from the turning part 26 in two corners 233 and 234 (two corners on a lower side of a paper plane) of the rectangle on the air flow downstream side is arc-shaped.

On the other hand, in each of the louvers 23 belonging to the downstream louver group, in the sectional surface perpendicular to the flat portions 21 and parallel to the air flowing direction, a corner 236 on a side farther from the turning part 26 in two corners 235 and 236 (two corners on a lower side of a paper plane) of the rectangle on the air flow upstream side is arc-shaped. In each of the louvers 23 belonging to the downstream louver group, in the sectional surface perpendicular to the flat portions 21 and parallel to the air flowing direction, a corner 237 on a side closer to the turning part 26 in two corners 237 and 238 (two corners on the upper side of a paper plane) of the rectangle on the air flow downstream side is arc-shaped.

Incidentally, when the thickness t of the louvers 23 is set to be relatively large as compared with the louver pitches PL, inter-louver passages 230 are narrowed. This makes it difficult to allow the air to flow in the inter-louver passages 230, resulting in a reduction in the heat transfer performance of the fins 2.

On the contrary, as in the present embodiment, the shape of each louver 23 in the sectional surface perpendicular to the flat portion 21 and parallel to the air flowing direction is arc-shaped in the regions corresponding to the two corners of the rectangle, thereby making it easy to allow the air to flow into the inter-louver passages 230. With the above configuration, when the thickness t of the louvers 23 is set to be relatively thick as compared with the louver pitches PL, the heat transfer performance of the fins 2 can be restrained from being reduced.

(Fourth Embodiment)

Subsequently, a fourth embodiment of the present disclosure will be described with reference to FIG. 20. The fourth embodiment is different from the third embodiment described above in the shape of the louvers 23.

Figure 20:
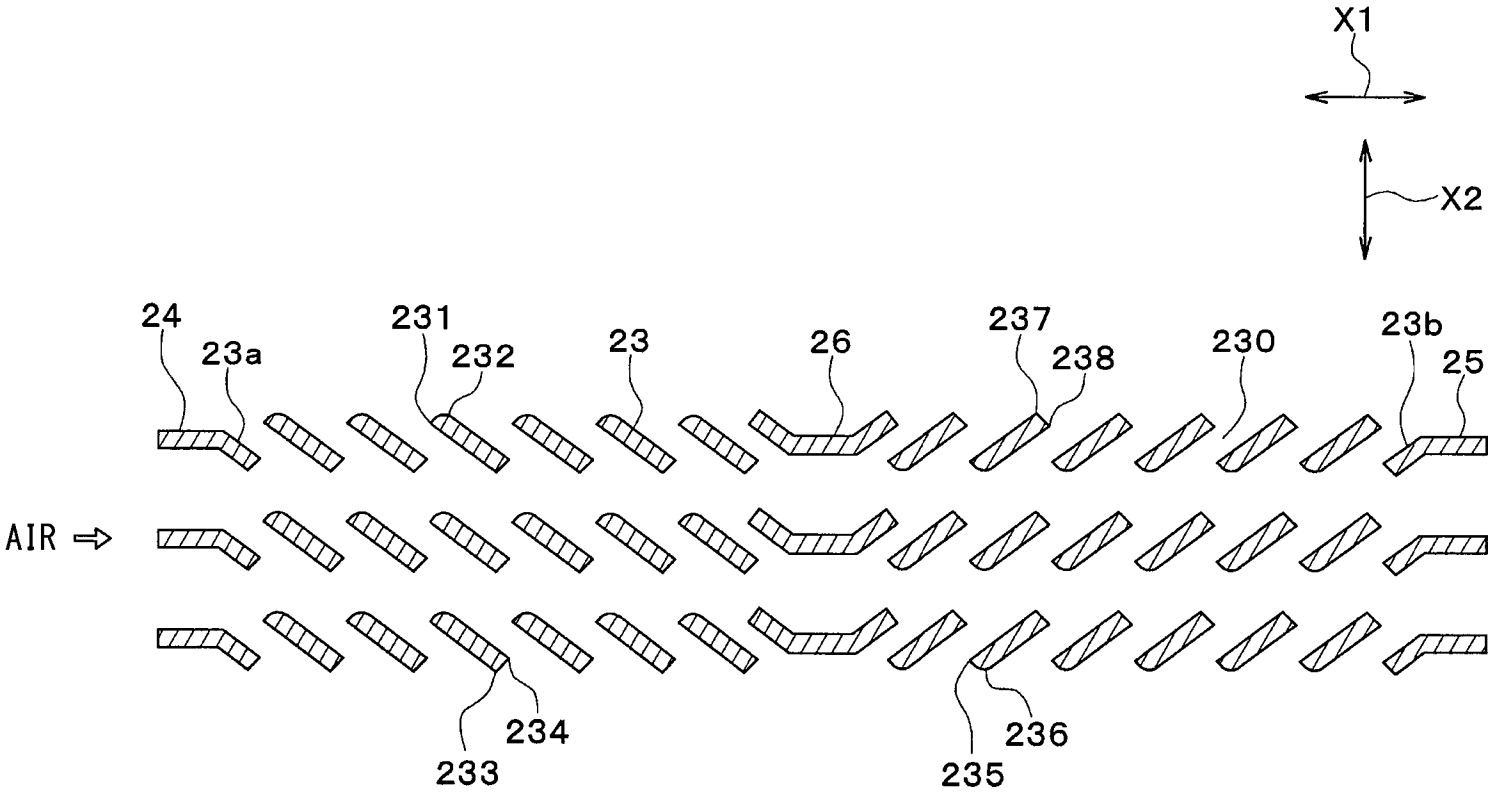
FIG. 20 is a sectional view illustrating a sectional surface perpendicular to a flat portion of a fin and parallel to an air flowing direction according to a fourth embodiment of the present disclosure.

As illustrated in FIG. 20, in the present embodiment, in all of louvers 23 formed in one flat portion 21 of each fin 2, a shape of a sectional surface perpendicular to the flat portion 21 and parallel to the air flowing direction is arc-shaped in a region corresponding to one corner of a rectangle.

Specifically, in each of the louvers 23 belonging to an upstream louver group, in the sectional surface perpendicular to the flat portions 21 and parallel to the air flowing direction, a corner 232 on a side closer to a turning part 26 in two corners 231 and 232 (two corners on an upper side of a paper plane) of the rectangle on the air flow upstream side is arc-shaped. On the other hand, in each of the louvers 23 belonging to the downstream louver group, in the sectional surface perpendicular to the flat portions 21 and parallel to the air flowing direction, a corner 236 on a side farther from the turning part 26 in two corners 235 and 236 (two corners on a lower side of a paper plane) of the rectangle on the air flow upstream side is arc-shaped.

In the present embodiment, since the shape of each louver 23 in the sectional surface perpendicular to the flat portion 21 and parallel to the air flowing direction is arc-shaped in the region corresponding to one corner of the rectangle, the air easily flows into the inter-louver passages 230. With the above configuration, the same advantages as those in the above third embodiment can be obtained.

The present disclosure is not limited to the above-described embodiments, but various modifications can be made thereto as follows without departing from the spirit of the present disclosure.

(1) In the above respective embodiments, the example in which the tubes 1 are employed as the heat exchange object, and a so-called "fin and tube type heat exchanger" is employed as the heat exchanger has been described. However, the present disclosure is not limited to the above configuration. For example, an electronic component or a machine which generates a heat such as a power card or an inverter element may be employed as the heat exchange object, and a heat exchanger configured to join the fin directly to the electronic component may be employed as the heat exchanger.

(2) In the above respective embodiments, the example in which the heater core or the radiator is employed as the heat exchanger has been described. However, the heat exchanger is not limited to this example. For example, a condenser that performs a heat exchange between a refrigerant and air flowing in a vehicle refrigeration cycle (air conditioning apparatus) to cool the refrigerant, or an intercooler that cools a combustion air (intake air) to be supplied to an internal combustion engine (engine) may be employed as the heat exchanger.

(3) In the above respective embodiments, the example in which the louvers 23 are formed in each fin (outer fin) 2 joined to the outer surfaces of the tubes 1 has been described. However, the present disclosure is not limited to this configuration, but the louvers 23 may be formed in inner fins disposed in the interior of the tubes 1.

(4) In the above third and fourth embodiments, the example in which the shape of each louver 23 in the sectional surface perpendicular to the flat portion 21 and parallel to the air flowing direction is arc-shaped in the region corresponding to two or one corner of the rectangle has been described. However, the present disclosure is not limited to this configuration, but the regions corresponding to three or four corners of the rectangle may be arc-shaped.

In other words, since the shape of each louver 23 in the sectional surface perpendicular to the flat portion 21 and parallel to the air flowing direction may be arc-shaped in a region corresponding to at least one corner of the rectangle. In this case, an arbitrary corner of the rectangle may be arc-shaped.

(5) In the above third and fourth embodiments, the example in which in all of the louvers 23 formed in each flat portions 21 of the fins 2, the shape in the sectional surface perpendicular to the flat portion 21 and parallel to the air flowing direction is arc-shaped in the region corresponding to at least one corner of the rectangle has been described. However, the present disclosure is not limited to this configuration. In other words, in at least one louver of the multiple louvers 23 formed in each flat portion 21 of the fins 2, the shape in the sectional surface perpendicular to the flat portion 21 and parallel to the air flowing direction may be arc-shaped in the region corresponding to at least one corner of the rectangle.

What is claimed is:

1. A fin for a heat exchanger, the fin being joined to an outer surface of a heat exchange object and facilitating a heat exchange between the heat exchange object and a fluid flowing around the heat exchange object, the fin comprising:

flat portions substantially parallel to a flowing direction of the fluid;

a ridge portions connecting adjacent two of the flat portions; and louvers disposed in the flat portions along a flowing direction of the fluid, wherein the flat portions and the ridge portion are corrugated in a sectional surface perpendicular to the flowing direction of the fluid as a whole, the louvers are cut in and raised from the flat portions at a predetermined cut-and-raised angle, a thickness of each flat portion is defined as t, a louver pitch of the louvers is defined as PL, and the thickness of each flat portion and the louver pitch satisfy a relationship of $0.035 \leq t/PL \leq 0.29$, and two of four corners of at least one of the louvers in a sectional surface perpendicular to the flat portions and parallel to the flowing direction of the fluid have arc shapes, and the two corners having the arc shapes are positioned on a diagonal line of the at least one of the louvers in the sectional surface.

2. The fin for a heat exchanger according to claim 1, wherein the thickness of each flat portion and the louver pitch satisfy a relationship of $0.035 \leq t/PL \leq 0.17$.

3. The fin for a heat exchanger according to claim 1, wherein the louver pitch of the louvers falls within a range larger than 0.09 mm and smaller than 0.62 mm, the thickness of each flat portion falls within a range larger than 0.006 mm and smaller than 0.05 mm, a fin height falls within a range larger than 1.4 mm and smaller than 6.5 mm, and the predetermined cut-and-raised angle falls within a range larger than 22.5° and smaller than 43.5°.

4. The fin for a heat exchanger according to claim 2, wherein the louver pitch of the louvers falls within a range larger than 0.3 mm and smaller than 0.62 mm, the thickness of each flat portion falls within a range larger than 0.006mm and smaller than 0.05 mm, a fin height falls within a range larger than 1.4 mm and smaller than 6.5 mm, and the predetermined cut-and-raised angle falls within a range larger than 22.5° and smaller than 43.5°.

5. The fin for a heat exchanger according to claim 1, wherein other two of the four corners of the at least one of the louvers are right-angled.

* * * * *